US008683664B2

(12) United States Patent
Tuma et al.

(10) Patent No.: US 8,683,664 B2
(45) Date of Patent: Apr. 1, 2014

(54) TOUCH-AND-CLOSE FASTENER PART

(75) Inventors: Jan Tuma, Mönchberg (DE); Metin Efe, Aidlingen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 246 days.

(21) Appl. No.: 12/735,504

(22) PCT Filed: Jan. 21, 2009

(86) PCT No.: PCT/EP2009/000346

§ 371 (c)(1),
(2), (4) Date: Jul. 22, 2010

(87) PCT Pub. No.: WO2009/097965

PCT Pub. Date: Aug. 13, 2009

(65) Prior Publication Data

US 2010/0287744 A1 Nov. 18, 2010

(30) Foreign Application Priority Data

Feb. 8, 2008 (DE) ..... 10 2008 008 104

(51) Int. Cl.
*A44B 18/00* (2006.01)

(52) U.S. Cl.
USPC ..... 24/452

(58) Field of Classification Search
USPC ..... 24/442, 444, 445, 447, 449, 452, 289, 24/710.5, 129 B, 129 R, 129 W, 130, 563, 24/570, 698.1, 698.2; 428/100, 99; 29/897.2; 72/186, 325, 326, 379.2
See application file for complete search history.

(56) References Cited

U.S. PATENT DOCUMENTS

| | | | | |
|---|---|---|---|---|
| 2,936,861 | A * | 5/1960 | Richardson | 403/404 |
| 3,808,646 | A * | 5/1974 | Brumlik | 24/710.5 |
| 4,169,303 | A * | 10/1979 | Lemelson | 24/452 |
| 4,442,155 | A * | 4/1984 | Foertsch et al. | 428/99 |
| 6,099,553 | A * | 8/2000 | Hart et al. | 606/232 |
| 7,950,115 | B2 * | 5/2011 | Spitz | 24/458 |
| 2008/0086850 | A1 * | 4/2008 | Smith et al. | 24/289 |
| 2008/0244878 | A1 * | 10/2008 | Hoehe et al. | 24/445 |
| 2010/0026028 | A1 * | 2/2010 | Smith et al. | 296/29 |
| 2010/0257704 | A1 * | 10/2010 | Tuma et al. | 24/449 |

FOREIGN PATENT DOCUMENTS

| | | | |
|---|---|---|---|
| DE | 44 41 095 | A1 | 5/1996 |
| DE | 10 2006 015 145 | A1 | 10/2007 |

* cited by examiner

*Primary Examiner* — Robert J Sandy
*Assistant Examiner* — Louis Mercado
(74) *Attorney, Agent, or Firm* — Roylance, Abrams, Berdo & Goodman LLP

(57) ABSTRACT

A touch-and-close fastener part includes a two-dimensional carrier (1) and a main tang (7) extending from the carrier. The main tang has at least one secondary tang (9) located on it and supporting the main tang (7) on the carrier (1). The fastener part can be obtained as hooking elements (5), in particular by punching or cutting. The main tang (7) can be raised up about a bending line (13) forming a first connecting region with carrier (1), into a functional position over the carrier (1). The secondary tang (9) forms a connecting area lying against the carrier (1) and representing a second connecting region.

12 Claims, 6 Drawing Sheets

TOUCH-AND-CLOSE FASTENER PART

FIELD OF THE INVENTION

The invention relates to a touch-and-close fastener part having a two-dimensional backing from which a hooking main tang with at least one secondary tang located thereon can be obtained as hooking elements, especially by punching or cutting. The secondary tang supports the main tang on the backing. The main tang can be raised into a working position over the backing around a bending line forming a first connecting region to the backing.

BACKGROUND OF THE INVENTION

A touch-and-close fastener part of this type is disclosed in DE 44 41 095 C2. The secondary tangs help to increase the structural strength of the main tangs having on their end regions the actual mushroom-shaped or hook-shaped hooking elements. These touch-and-close fastener parts are suitable for producing touch-and-close fasteners suitable for demanding operating conditions, for example, for anchoring grinding wheels or coarse fiber nonwovens in grinding machines, or floor care implements. These touch-and-close fasteners produced from plastic cannot be used in those applications due to high mechanical loads and thermal loads because of the lack of temperature stability. To exploit the advantages of proven plastic-based touch-and-close fastener systems, as are most common for a plurality of applications, even in those applications in which plastic touch-and-close fasteners cannot be used, DE 10 2006 015 145 A1 discloses a type of metal touch-and-close fastener by the hooking elements being cut out from a metal backing, for example, a heat-resistant metal alloy such as high-grade steel, and raised. These fastening systems enable prompt and simple installation of third components without the need for additional holding devices and their actuation by special tools. Special demands must be imposed on the operating behavior of these fastening systems. In particular, a relatively large holding force must be present to secure the pertinent parts against static or dynamic (oscillations) load forces which may occur.

SUMMARY OF THE INVENTION

An object of the invention is to provide a touch-and-close fastener part having hooking elements including main tangs and secondary tangs ensuring especially strong and reliable anchoring of the hooking elements on the backing.

This object is basically achieved according to the invention by a touch-and-close fastener part having at least one secondary tang located on the respective main tang and made and arranged such that the secondary tang forms a connecting surface adjoining the backing and forming a second connecting region on the backing. This two-dimensional linking of the hooking elements to the backing and the resulting increase of structural strength make these touch-and-close fastener parts suitable for applications in which large adhesive forces and high resistivity are necessary.

In particular, these touch-and-close fastener parts are suitable for implementation of metal touch-and-close fasteners intended for applications in which high mechanical and/or thermal loads occur.

In especially advantageous exemplary embodiments, the main tang on its foot part adjoining the backing has a pair of secondary tangs, each in the form of one strip-like extension adjoining one side edge of the foot part. In this way, the connecting surfaces are laterally offset relative to one another and are especially suitable for delivering into the backing the forces produced by bending moments.

Preferably, the foot part widens toward the bending line with side edges diverging relative to one another. Around the bending line, the foot part is raised out of the backing plane. The extensions forming the secondary tangs are formed by notches in the backing bordering the bending line on both sides and forming projections of the diverging side edges.

In this arrangement, the extensions can be displaced to under the backing around second bending lines laterally adjoining the ends of the bending line of the foot part, can be guided along the bottom of the backing up to an opening in the backing, and can be displaced up onto the backing on third bending lines through the opening in the backing. In this way an overall connecting surface is created formed of the contact surface located underneath the backing plus the contact surface on the top of the backing by the end sections of the extensions. The end sections are displaced onto the backing.

In alternative exemplary embodiments in which the connecting surfaces between the extensions forming the secondary tangs and the backing are located entirely on its underside, the sections of the secondary tangs adjoining the underside of the backing are overlapped by an assigned auxiliary tang cut out of the backing, and are kept in contact with the underside of the backing.

In this respect, the auxiliary tangs are formed by cutouts of the backing such that the cut-out auxiliary tangs can be displaced around fourth bending lines extending along the end edges of the secondary tangs adjoining the underside of the backing and can be placed on the secondary tangs.

In the production of the touch-and-close fastener part according to the invention, the main tangs with the foot part and the secondary tangs can be formed by a single cutout of the backing with a single cutting line uninterrupted except for the connecting site to the backing forming the bending line on the foot part. This cutting line enables simple and efficient production. Prior to bending processes carried out for raising and displacing the tang parts, simply a single cutting or punching step is necessary to form the main and secondary tangs, optionally combined with a cutting or punching process for forming the auxiliary tangs.

The touch-and-close fastener part according to the invention is especially suited for forming a metal touch-and-close fastener, with a suitable metal backing being provided. For example, a steel sheet of steel alloy is suitable for the intended application.

In especially advantageous exemplary embodiments, connecting sites are provided on the connecting surfaces, for example, by cementing or spot welding. Preferably, these connecting sites are also provided between auxiliary tangs, with the regions of the secondary tangs covered by them.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
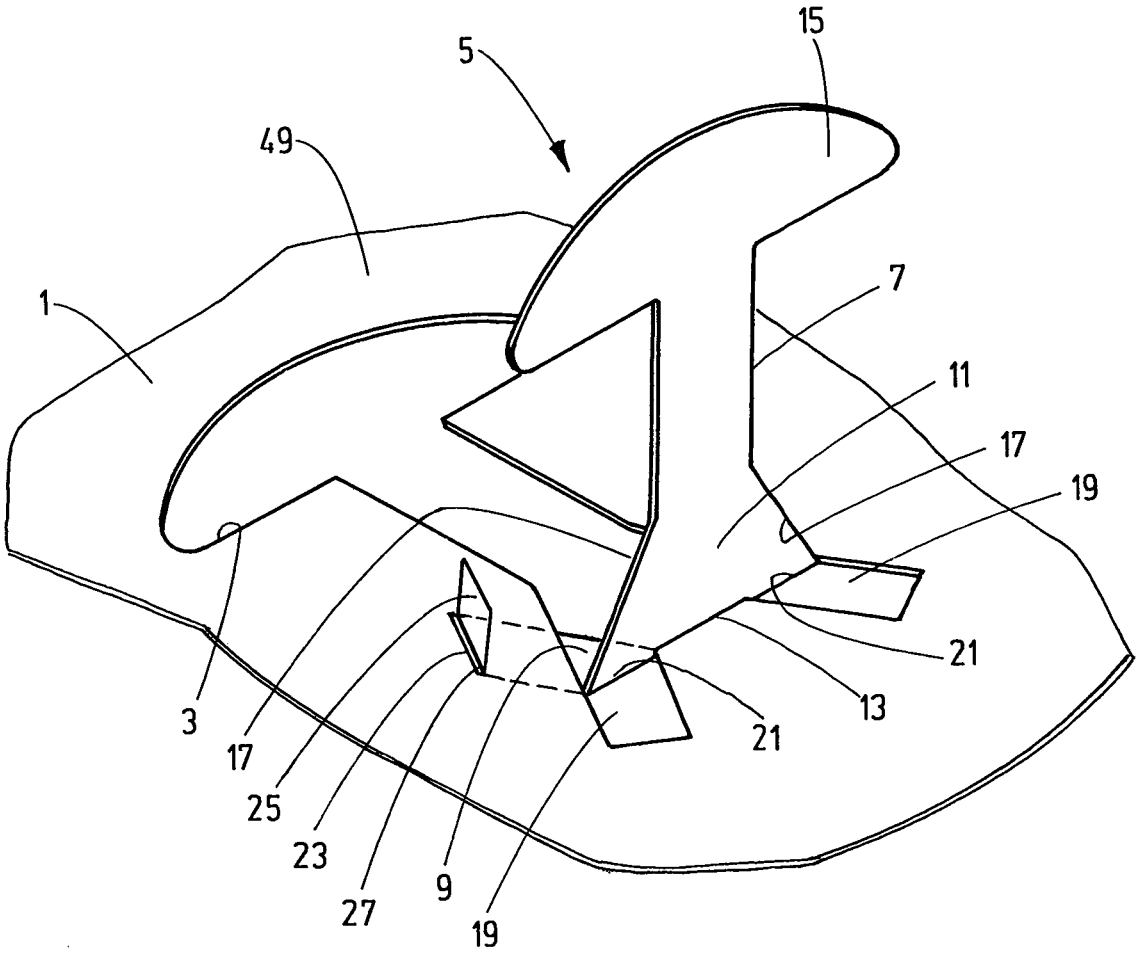
FIG. 1 is a perspective view of only one partial section of a touch-and-close fastener part including backing with a single hooking element of a main tang and a pair of secondary tangs according to a first exemplary embodiment of the invention, which view is shown greatly enlarged to illustrate the operating principle of the invention, with the end section of the secondary tang shown in the figure not yet being displaced to the final degree.
Figure 2:
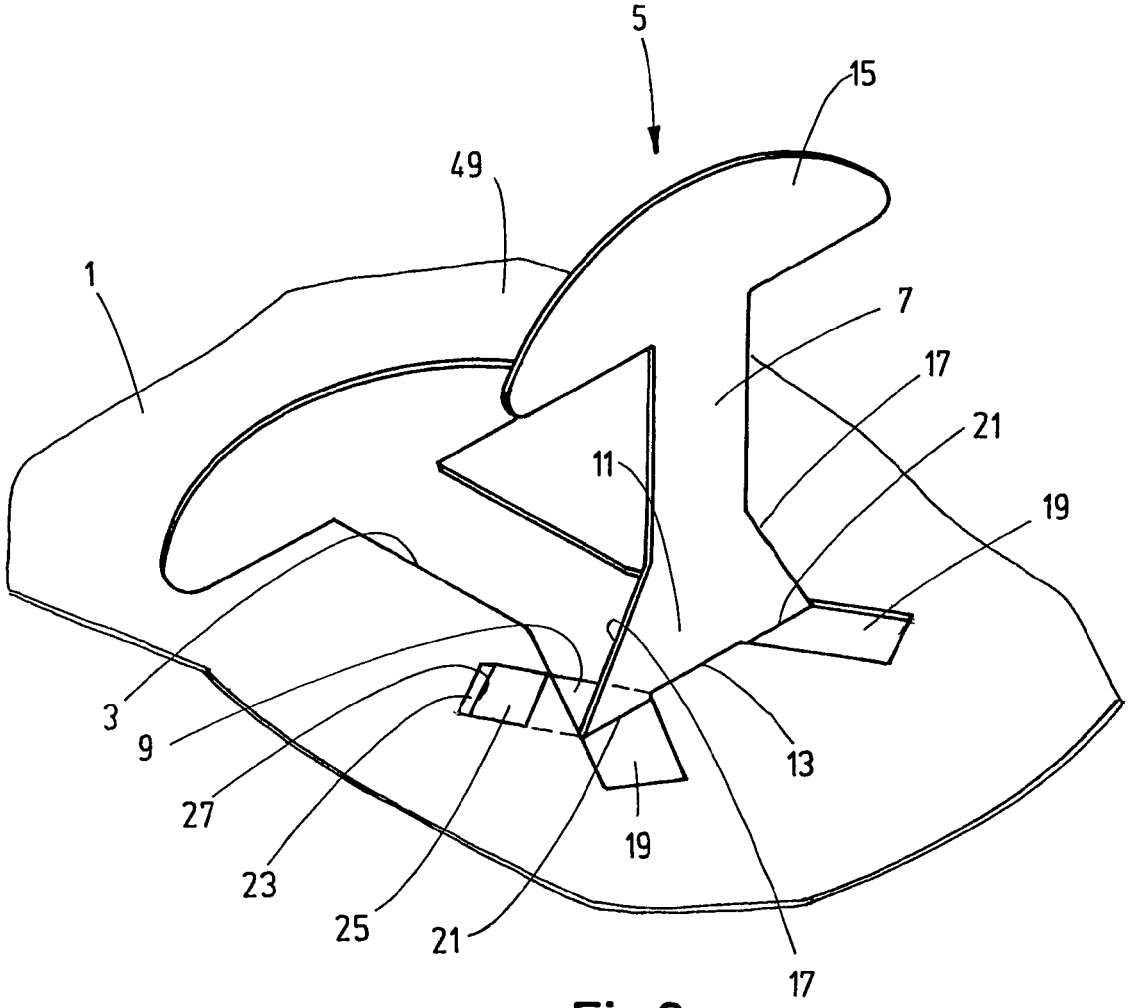
FIG. 2 is a perspective of the touch-and-close fastener part of FIG. 1, with the visible secondary tang being shown in the ultimately displaced position.

The invention is described below using exemplary embodiments in which the touch-and-close fastener part is designed to form a metal touch-and-close fastener having a metal backing 1. Depending on the intended application, the backing can be a steel sheet, made, for example, of a highly heat-resistant, high-grade steel alloy. The sheet thicknesses can be chosen accordingly, for example, in a range from 0.1 to 2 mm. Cutting or punching with a cutting line 3 forms the outline of the hooking elements 5, each including a main tang 7 and a pair of secondary tangs 9 integrally joined to the main tang 7. Only one of the secondary tangs are shown in FIGS. 1 and 2, with another of the secondary tangs 9 in the direction of FIGS. 1 and 2 concealed by the foot part 11 of the main tang 7. Foot part 11 is widened toward the bottom and forms a partial triangle. This foot part 11 is connected to the backing 1 by a straight bending line 13 around which the main tang 7 is raised out of the plane of the backing 1. As is apparent from FIGS. 1 and 2, to form the main tangs 7 and secondary tangs 9, only a single cutting line 3 is necessary and extends without interruption as far as the ends of the bending line 13; i.e., it is interrupted solely by the bending line 13. The upper head part 15 is made in the form of mushroom head to be used as an effective anchoring part of the formed hooking element 5.

The secondary tangs 9 are formed by extensions adjoining the foot part 11 on the two side edges 17, and are formed by notches 19 of the backing 1 having the shape of a partial rectangle, with one longitudinal side of each notch 19 forming a prolongation of the bordering side edge 17 of the foot part 11. The notches 19 are closed by second bending lines 21, each forming lateral prolongations of the bending line 13 on which the foot part 11 is joined to the backing 1. As FIGS. 1 and 2 show, the secondary tangs 9 are displaced around the second bending lines 21 under the underside of the backing 1 and are guided on the underside of the backing 1 up to slot-shaped openings 23 through which the respective end parts 25 of the secondary tangs 9 are inserted toward the top. FIG. 1 shows the end parts 25 inserted through the openings 23, but not yet displaced onto the top of the backing 1 around a third bending line 27 located on the opening 23. FIG. 2 shows this finished state, where the end parts 25 of the secondary tangs 9 rest on the top of the backing 1.

As is apparent, the secondary tangs 9 form large-area connecting surfaces for anchoring the main tang 7 on the backing 1. Because the notches 19 and the resulting secondary tangs 9 formed thereby extend divergently, the secondary tangs 9 are spread to the sides relative to the central region of the foot part 11 so that support and anchoring take place laterally outside of the cutting line 3, and therefore, in a region of the backing 1. That support and anchoring is favorable for delivery of the load forces. On the connecting surfaces to the backing 1, i.e., along the secondary tangs 9 underneath the backing 1 and between the end parts 25 and the top of the backing 1, connecting sites are provided by spot welding or cementing.

Figure 3:
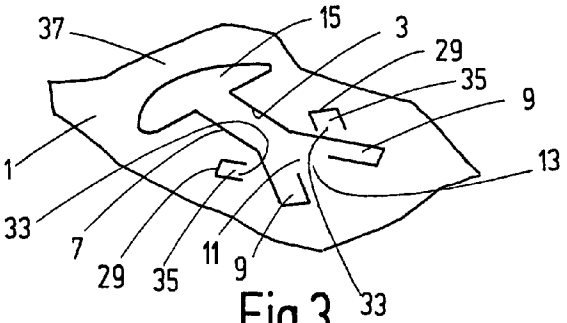
FIG. 3 is a perspective view of a backing section, less dramatically enlarged compared to FIGS. 1 and 2, with cutting lines for forming a hooking element of a second exemplary embodiment of a touch-and-close fastener part according to the invention.
Figure 3B:
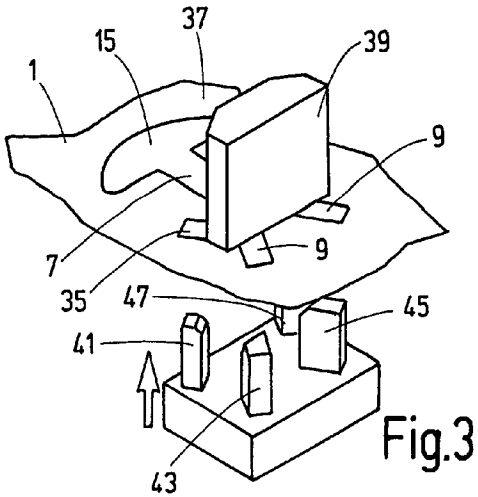
FIGS. 3*a* to 3*l* are perspective views schematically illustrating successive working steps of production of the touch-and-close fastener part of FIG. 3.
Figure 3A:
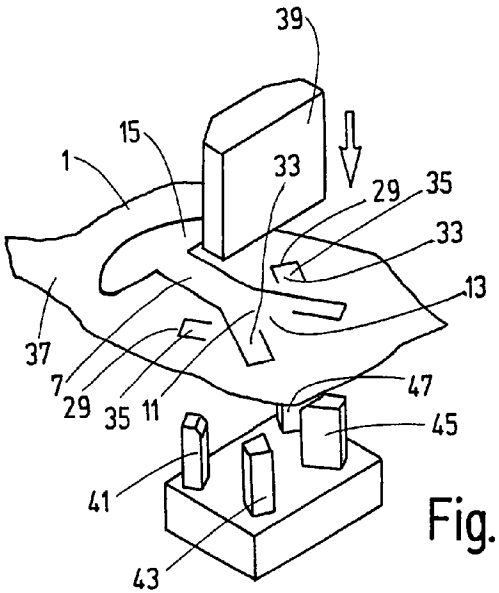
Figure 3C:
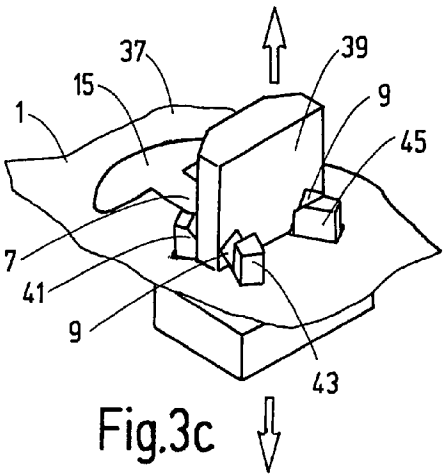
Figure 3F:
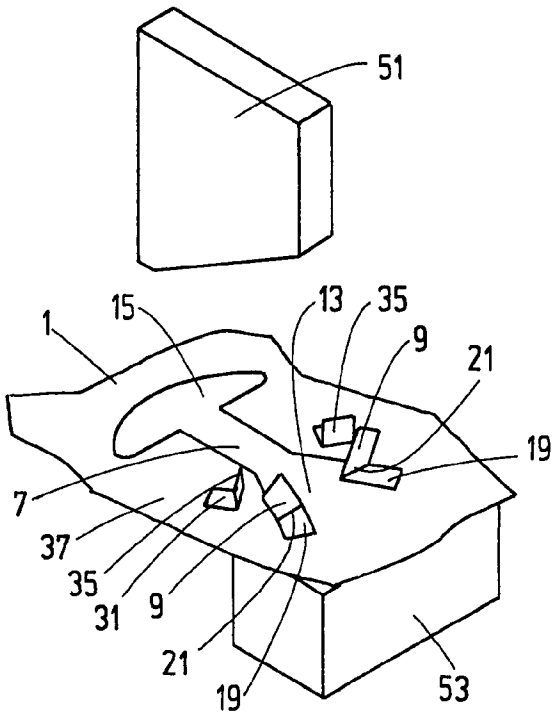
Figure 3E:
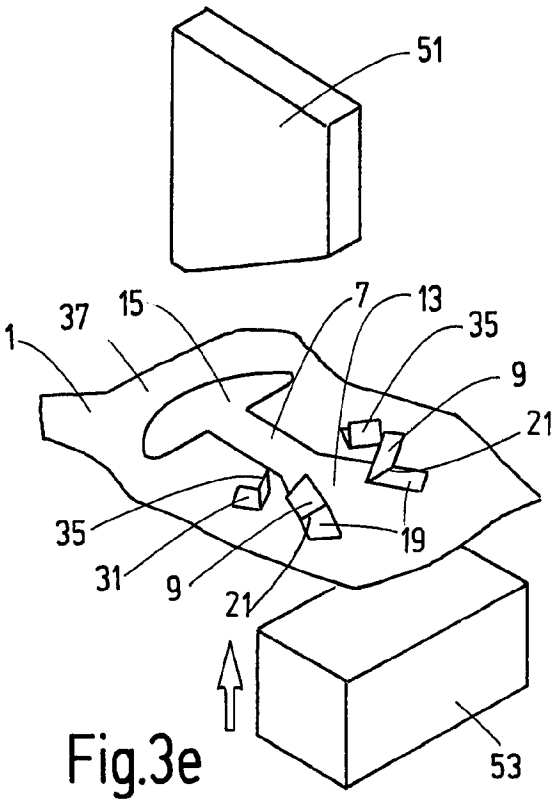
Figure 3D:
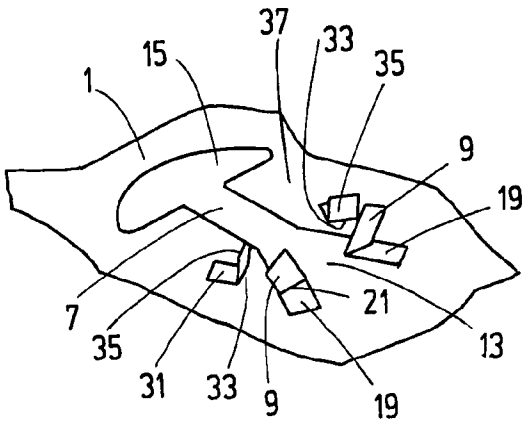
Figure 3I:
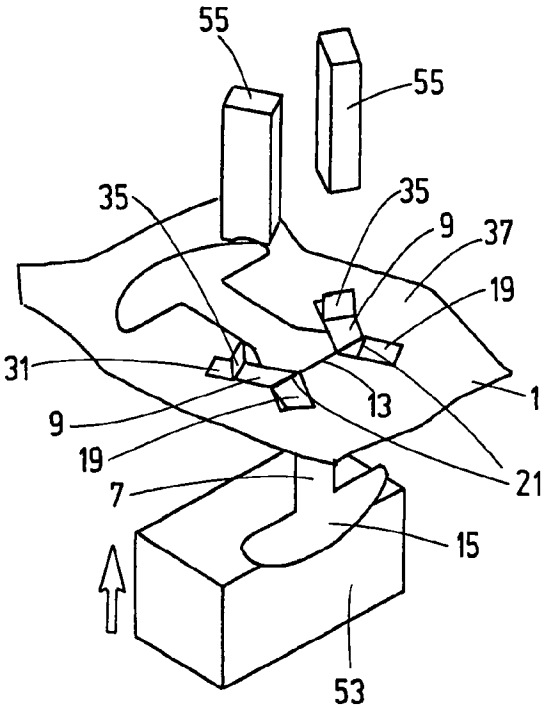
Figure 3H:
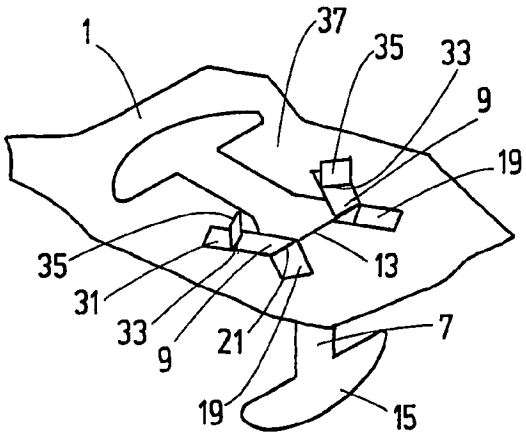
Figure 3G:
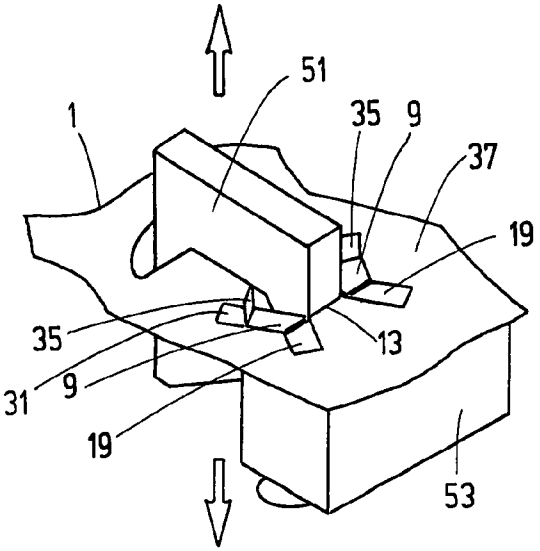
Figure 3L:
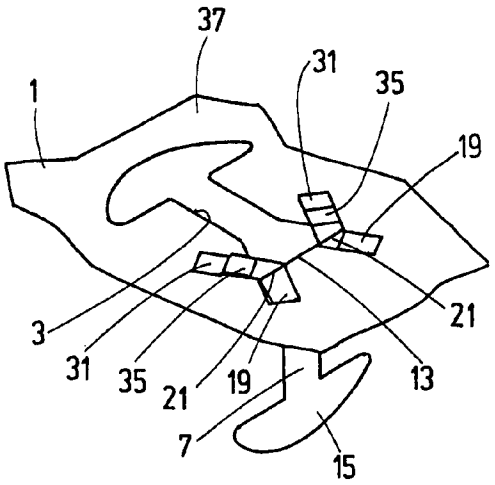
Figure 3K:
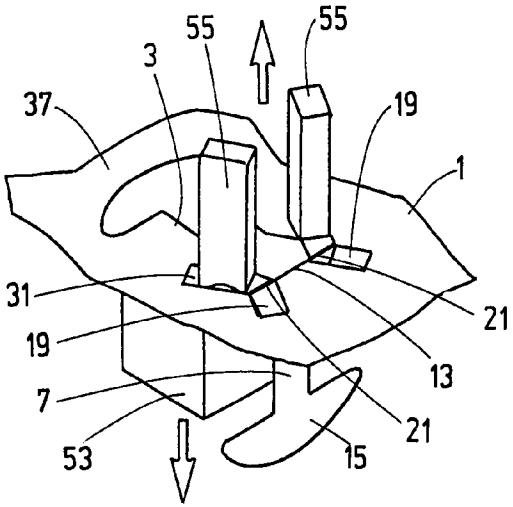
Figure 3J:
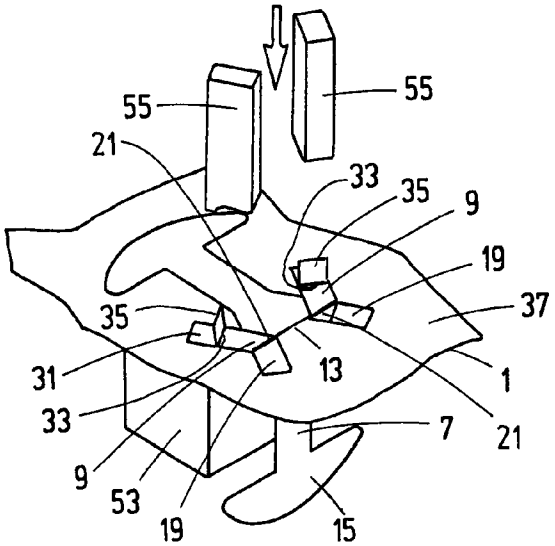
Figure 4:
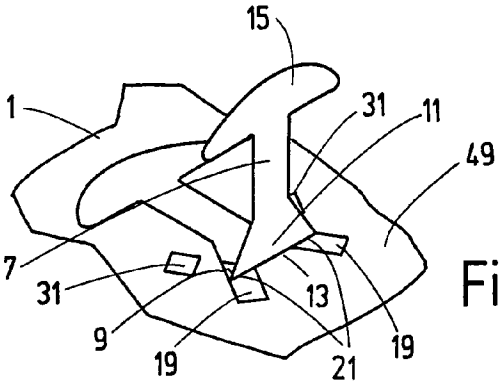
FIG. 4 is a perspective view of the touch-and-close fastener part of FIG. 3 with backing section enlarged accordingly and with the completed hooking element.

FIGS. 3 and 4 show a modified or second exemplary embodiment. As is best shown in FIGS. 3 and 3*a*-3*l*, in the backing 1 outside the cutting line 3 forming the main tang 7 and the pair of secondary tangs 9 and uninterrupted except for the bending line 13 on the foot part 11, additional cutting lines 29 delineate the cutouts 31 joined to the backing 1 on the fourth bending lines 33. These cutouts 31 are used to form auxiliary tangs 35, see FIG. 3*d*. FIG. 3*d* shows the backing 1, viewed on its underside or bottom 37, in which the secondary tangs 9 are displaced first around the bending lines 21 and stand up on the underside 37 of the backing 1. Likewise, FIG. 3*d* shows that around the fourth bending lines 33 the auxiliary tangs 35 are also raised on the underside 37 of the backing 1, but are not yet displaced. Proceeding from the state of FIG. 3*a*, this bending is accomplished by the sequence of production steps of FIGS. 3*a*, 3*b*, and 3*c*, specifically in the interaction of a hold-down device 39 and dies 41, 43, 45, and 47, see FIGS. 3*a* to 3*c*, each likewise looking at the underside or bottom 37 of the backing 1.

FIGS. 3*e* to 3*g*, in the direction of the underside 37 of the backing 1, show the raising of the main tang 7 from the top 49 of the backing 1 visible in FIG. 4. This raising takes place, see FIGS. 3*e to* 3*g*, by a beveled die 51 and counterstay 53, proceeding from the state of FIGS. 3*e* and 3*f* with both the main tang 7 being bent around the bending line 13 and also the secondary tangs 9 being placed around their bending lines 21 on the underside 37 of the backing 1, since the secondary tangs 9 are entrained by the pivoting motion of the main tang 7. FIG. 3*h* shows the state in which the secondary tangs 9 adjoin the underside or bottom 37 of the backing, but the auxiliary tangs 35 have not yet been displaced around their fourth bending lines 33 and are placed above the secondary tangs 9. This bending of the auxiliary tangs 35 takes place as shown in FIGS. 3*i* to 3*k* by dies 55, as a result of which the finished state shown in FIG. 3*l* is obtained in which the underside 37 of the completed touch-and-close fastener part can be seen. Conversely, FIG. 4 likewise shows the completed state with the top 49 of the backing 1 visible. As a comparison of FIGS. 3 and 4 best illustrates, in the second exemplary embodiment of FIGS. 3 and 4, all connecting surfaces are located between the secondary tangs 9 and the backing 1 on its underside or bottom 37, where the secondary tangs 9 adjoin along the underside or bottom 37 and are overlapped by the auxiliary tangs 35. In contrast, in the first exemplary embodiment as shown in FIGS. 1 and 2, connecting surfaces are on the underside or bottom 37 and top 49 of the backing 1, specifically by the sections of the secondary tangs extending along the underside or bottom 37 and their end parts 25 displaced through the openings 23 upward onto the top 49. As already mentioned, on all connecting surfaces, connecting sites are also between the auxiliary tangs 35 and secondary tangs 9.

While various embodiments have been chosen to illustrate the invention, it will be understood by those skilled in the art that various changes and modifications can be made therein without departing from the scope of the invention as defined in the appended claims.

What is claimed is:

1. A touch-and-close fastener part, comprising:

a two-dimensional backing;

a hooking main tang having an outline formed by one of cutting and punching from a portion of said backing and resulting in an aperture of said backing having an outline generally complementary to said outline of said main tang, said main tang being connected to and bent relative to said backing to a working position over said backing along a first bending line forming a first connecting region of said main tang to said backing; and a first secondary tang supporting said main tang on said backing formed by one of cutting and punching from a portion of said backing and connected to and bent relative to said backing along a second bending line, said secondary tang being integrally connected directly to said main tang and having a connecting surface abutting said backing to form a second connecting region of said main tang to said backing.

2. The touch-and-close fastener part according to claim 1 wherein said main tang comprises a foot part adjoining said backing, said foot part having first and second side edges, said first secondary tang being a strip-shaped extension of said first side edge, a second secondary tang being a strip-shaped extension of said second side edge supporting said main tang on said backing, being formed by one of cutting and punching from a portion of said backing and bent relative to said backing along a third bending line and having a second connecting surface abutting said backing forming a third connecting region of said main tang to said backing.

3. The touch-and-close fastener part according to claim 2 wherein said side edges of said foot part diverge relative to one another widening said foot part toward said first bending line;

said secondary tangs are formed by notches in said backing bordering said first bending line on both sides thereof and form projections of said side edges.

4. The touch-and-close fastener part according to claim 3 wherein said backing comprises first and second oppositely facing backing surfaces and first and second openings therein, said main tang extending from said first backing surface, said first and second secondary tangs extending along said second backing surface until said first and second openings, respectively, from said second and third bending lines, through said first and second openings, respectively, and then bent onto said first backing surface along fourth and fifth bending lines, respectively, said second and third bending lines adjoining opposite ends of said first bending line.

5. The touch-and-close fastener part according to claim 4 wherein said second and third connecting regions are formed by at least one of cementing and spot welding on connecting surfaces thereof.

6. The touch-and-close fastener part according to claim 3 wherein said backing comprises first and second oppositely facing backing surfaces and first and second openings therein, said main tang extending from said first backing surface, said first and second secondary tangs extending along said second backing surface until said first and second openings, respectively, from said second and third bend lines, sections of said secondary tangs extending along said second backing surface are overlapped by respective first and second auxiliary tangs cut out from said backing keeping said sections in contact with said second backing surface, said second and third bending lines adjoining opposite ends of said first bending line.

7. The touch-and-close fastener part according to claim 6 wherein said first and second auxiliary tangs are bent about first and second auxiliary bending lines, respectively, extending along end edges of said first and second secondary tangs, respectively, adjoining said second backing surface and are placed on said first and second secondary tangs, respectively.

8. The touch-and-close fastener part according to claim 6 wherein said second and third connecting regions are formed by at least one of cementing and spot welding on connecting surfaces thereof.

9. The touch-and-close fastener part according to claim 8 wherein connecting sites are between said auxiliary tangs and regions of said secondary tangs covered thereby.

10. The touch-and-close fastener part according to claim 1 wherein said main tangs and said secondary tangs are formed by a single cutout of said backing with a single cutting line uninterrupted until said first bending line.

11. The touch-and-close fastener part according to claim 1 wherein said backing is metallic.

12. The touch-and-close fastener part according to claim 1 wherein said main tang comprises a hooking element on a free end thereof opposite said first bending line.

* * * * *